US009199462B1

(12) United States Patent
Baumer et al.

(10) Patent No.: US 9,199,462 B1
(45) Date of Patent: Dec. 1, 2015

(54) PRINTHEAD WITH PRINT ARTIFACT SUPRESSING CAVITY

(71) Applicants: Michael Frank Baumer, Dayton, OH (US); Chang-Fang Hsu, Beavercreek, OH (US); Todd Russell Griffin, Webster, NY (US); Randy Lee Fagerquist, Fairborn, OH (US); Ronald J. Hill, Xenia, OH (US); Robert Link, Webster, NY (US); Gyanendra P. Sasmal, West Chester, OH (US); Qing Yang, Pittsford, NY (US)

(72) Inventors: Michael Frank Baumer, Dayton, OH (US); Chang-Fang Hsu, Beavercreek, OH (US); Todd Russell Griffin, Webster, NY (US); Randy Lee Fagerquist, Fairborn, OH (US); Ronald J. Hill, Xenia, OH (US); Robert Link, Webster, NY (US); Gyanendra P. Sasmal, West Chester, OH (US); Qing Yang, Pittsford, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/490,728

(22) Filed: Sep. 19, 2014

(51) Int. Cl.
*B41J 2/14* (2006.01)
*B41J 2/055* (2006.01)

(52) U.S. Cl.
CPC ..... *B41J 2/1433* (2013.01); *B41J 2/055* (2013.01)

(58) Field of Classification Search
CPC ..... B41J 2202/02; B41J 2/02; B41J 2/03; B41J 2/045; B41J 2/055
See application file for complete search history.

(56) References Cited

U.S. PATENT DOCUMENTS

| | | | | |
|---|---|---|---|---|
| 3,373,437 | A | 3/1968 | Sweet | |
| 3,560,641 | A | 2/1971 | Taylor et al. | |
| 3,596,275 | A | 7/1971 | Sweet | |
| 3,739,393 | A | 6/1973 | Lyon et al. | |
| 3,877,036 | A | 4/1975 | Loeffler et al. | |
| 3,878,519 | A | 4/1975 | Eaton | |
| 4,220,958 | A | 9/1980 | Crowley | |
| 4,638,328 | A | 1/1987 | Drake et al. | |
| 5,224,843 | A | 7/1993 | Van Lintel | |
| 6,257,703 | B1 * | 7/2001 | Hirosawa et al. | 347/50 |
| 6,387,225 | B1 | 5/2002 | Shimada et al. | |
| 6,457,807 | B1 | 10/2002 | Hawkins et al. | |
| 6,474,784 | B1 | 11/2002 | Fujii | |
| 6,491,362 | B1 | 12/2002 | Jeanmaire | |
| 6,505,921 | B2 | 1/2003 | Chwalek et al. | |
| 6,511,161 | B2 | 1/2003 | Sumi et al. | |
| 6,543,107 | B1 | 4/2003 | Miyashita et al. | |
| 6,554,410 | B2 | 4/2003 | Jeanmaire et al. | |
| 6,561,627 | B2 | 5/2003 | Jarrold et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,777,395 | B2 | 8/2010 | Xu et al. | |
| 7,938,516 | B2 | 5/2011 | Piatt et al. | |
| 2003/0001936 | A1 * | 1/2003 | Hirosawa et al. | 347/87 |
| 2010/0033542 | A1 | 2/2010 | Piatt et al. | |
| 2012/0300000 | A1 | 11/2012 | Panchawagh et al. | |

FOREIGN PATENT DOCUMENTS

| | | |
|---|---|---|
| JP | 59098859 | 6/1984 |
| JP | 06191030 | 7/1994 |

* cited by examiner

*Primary Examiner* — Geoffrey Mruk
(74) *Attorney, Agent, or Firm* — William R. Zimmerli

(57) ABSTRACT

A printhead includes a nozzle plate including a plurality of nozzles and a manifold body bonded to the nozzle plate. The manifold body includes a liquid channel in fluid communication with the plurality of nozzles. A cavity that dampens pressure modulation in liquid channel of the manifold body is located between the nozzle plate and the manifold body. The cavity is fluidically common to the plurality of nozzles.

10 Claims, 18 Drawing Sheets

PRINTHEAD WITH PRINT ARTIFACT SUPRESSING CAVITY

FIELD OF THE INVENTION

This invention relates generally to the field of digitally controlled printing devices, and in particular to continuous printing systems in which a liquid stream breaks into droplets that are deflected by a gas flow.

BACKGROUND OF THE INVENTION

Continuous inkjet printing is a printing technology that is well suited for high speed printing applications, having high throughput and low cost per page. Recent advances in continuous inkjet printing technology have included thermally induced drop formation, which is capable of selectively forming small drops and large drops, and air deflection of drops to separate the small drops from the large drops. These advances have enabled the print resolution to be significantly improved while maintaining the throughput of the printer.

It has been found that under certain printing conditions, print artifacts can be produced. There is a need for a more effective means to prevent the formation of such print artifacts.

SUMMARY OF THE INVENTION

According to one aspect of the invention, a printhead includes a nozzle plate including a plurality of nozzles and a manifold body bonded to the nozzle plate. The manifold body includes a liquid channel in fluid communication with the plurality of nozzles. A cavity that dampens pressure modulation in liquid channel of the manifold body is located between the nozzle plate and the manifold body. The cavity is fluidically common to the plurality of nozzles.

According to another aspect of the invention, liquid is provided to the printhead under pressure sufficient to emit a filament of liquid through the plurality of nozzles of the printhead, and a drop forming device associated with one of the plurality of nozzles of the printhead is selectively actuated to form liquid drops from the filament of liquid emitted through the associated nozzle of the plurality of nozzles.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
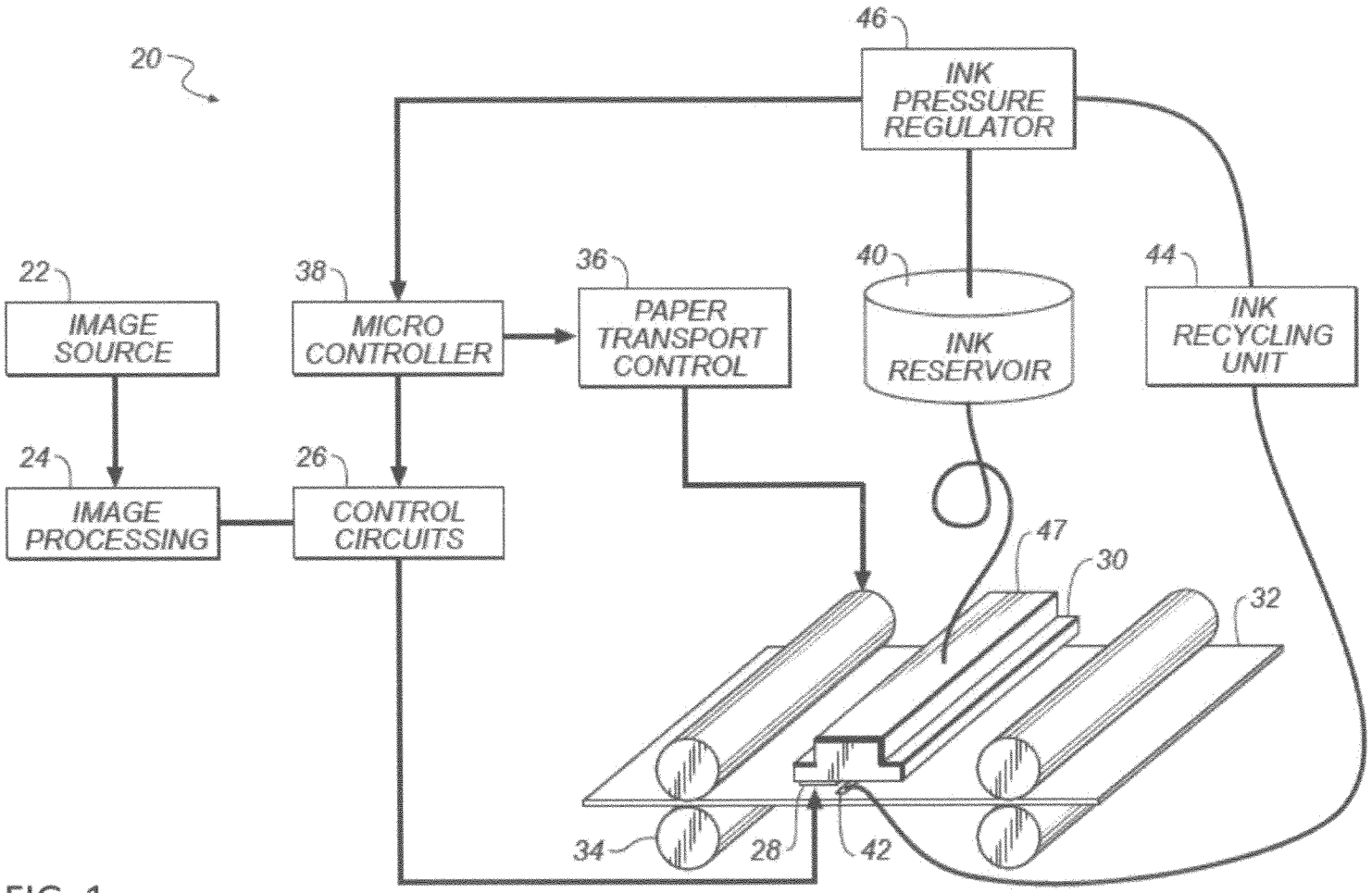
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
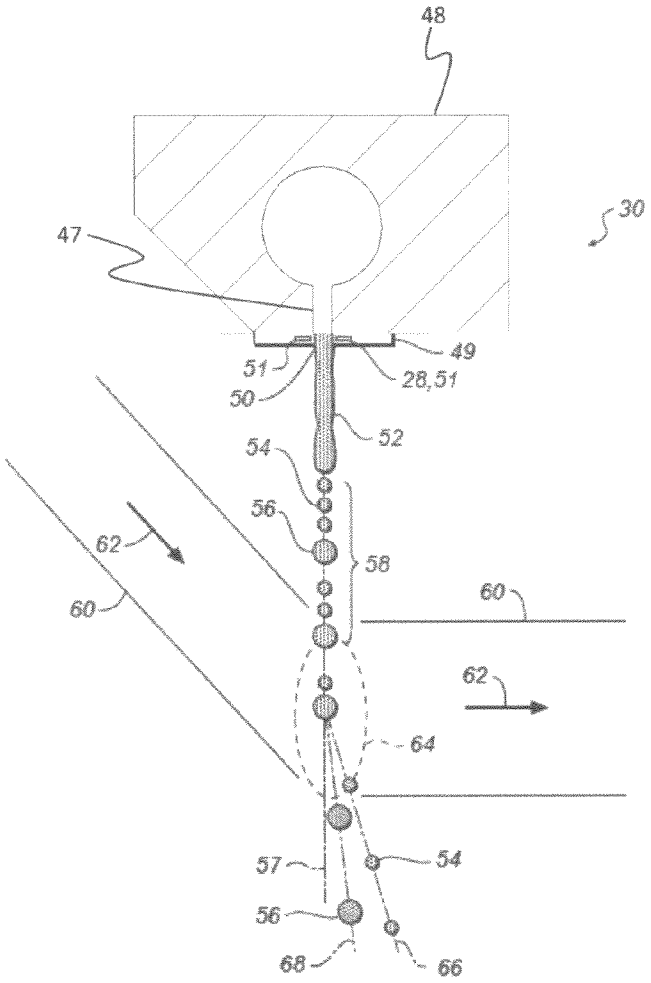
FIG. 2 is a schematic view of an example embodiment of a continuous printhead made in accordance with the present invention.
Figure 3:
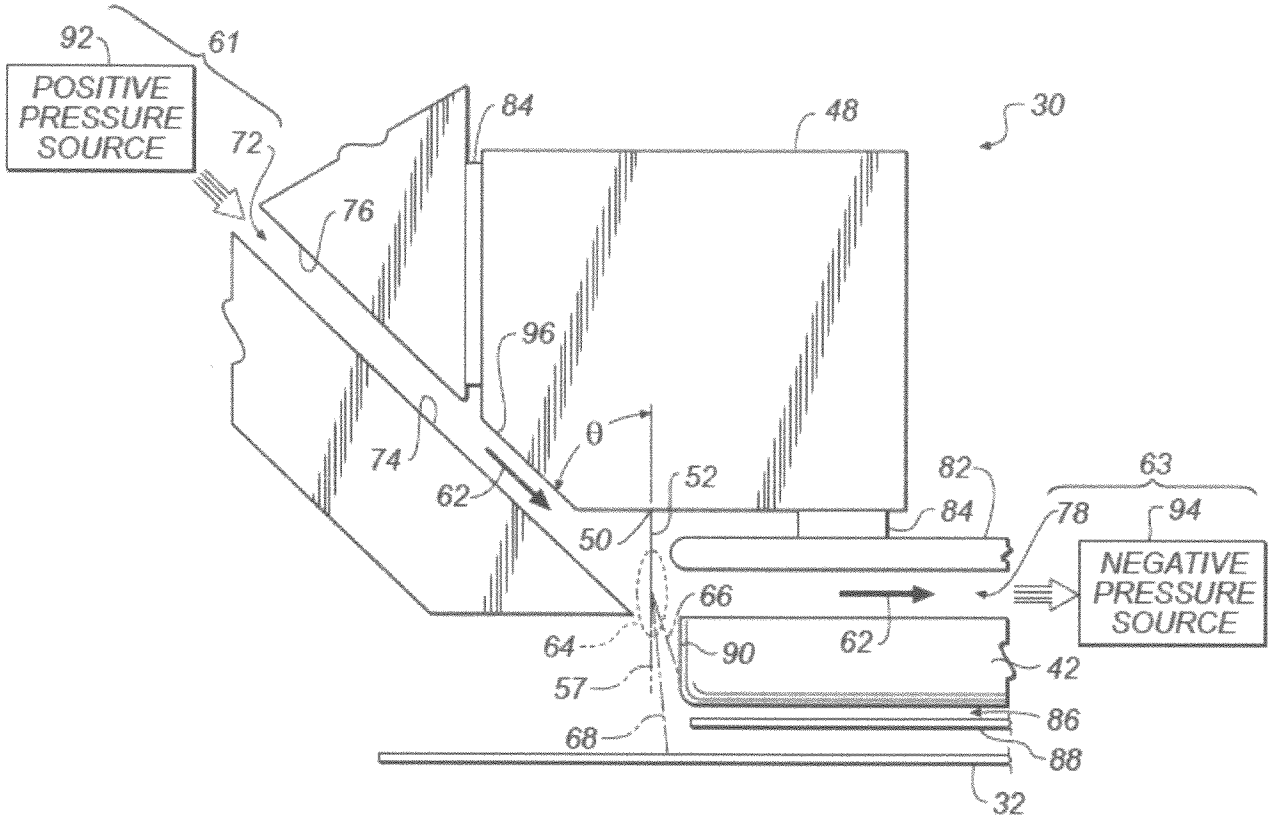
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
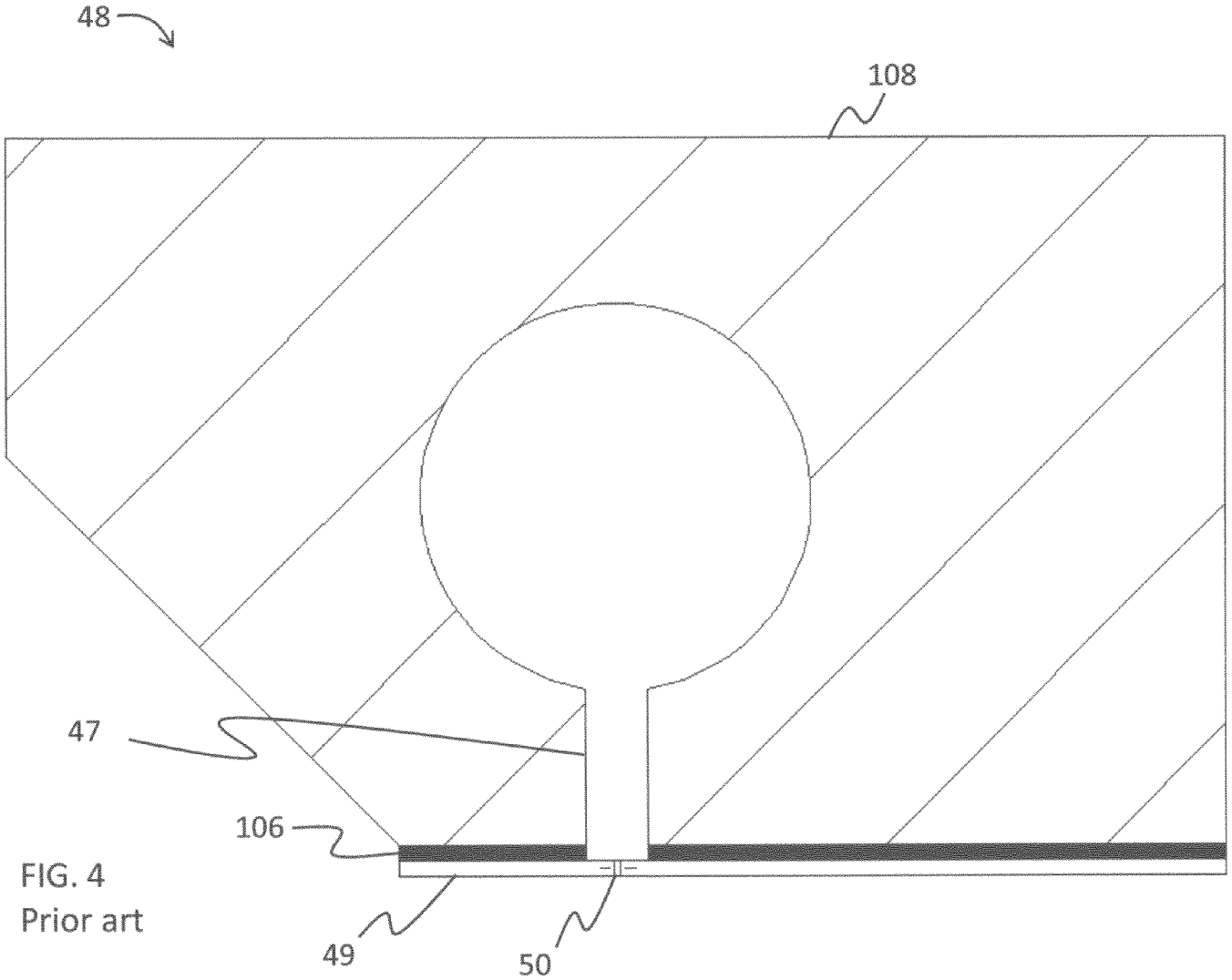
FIG. 4 Prior art
FIG. 4 is a schematic cross sectional view of a prior art jetting module.

FIG. 4 shows a cross section view of a prior art jetting module 48. The jetting module includes a manifold body 108 with a nozzle plate 49 bonded to the manifold body 108 using an adhesive 106. The manifold body 108 includes a liquid manifold or liquid channel 47 through which ink can be supplied under pressure to the nozzles 50. The nozzle plate 49 spans the ink channel 47 of the manifold body 108, so that ink supplied under pressure through the ink channel 47 can flow through the nozzles 50 of the nozzle plate to form filaments 52 (shown in FIGS. 2 and 3) of liquid from nozzles 50.

Figure 5:
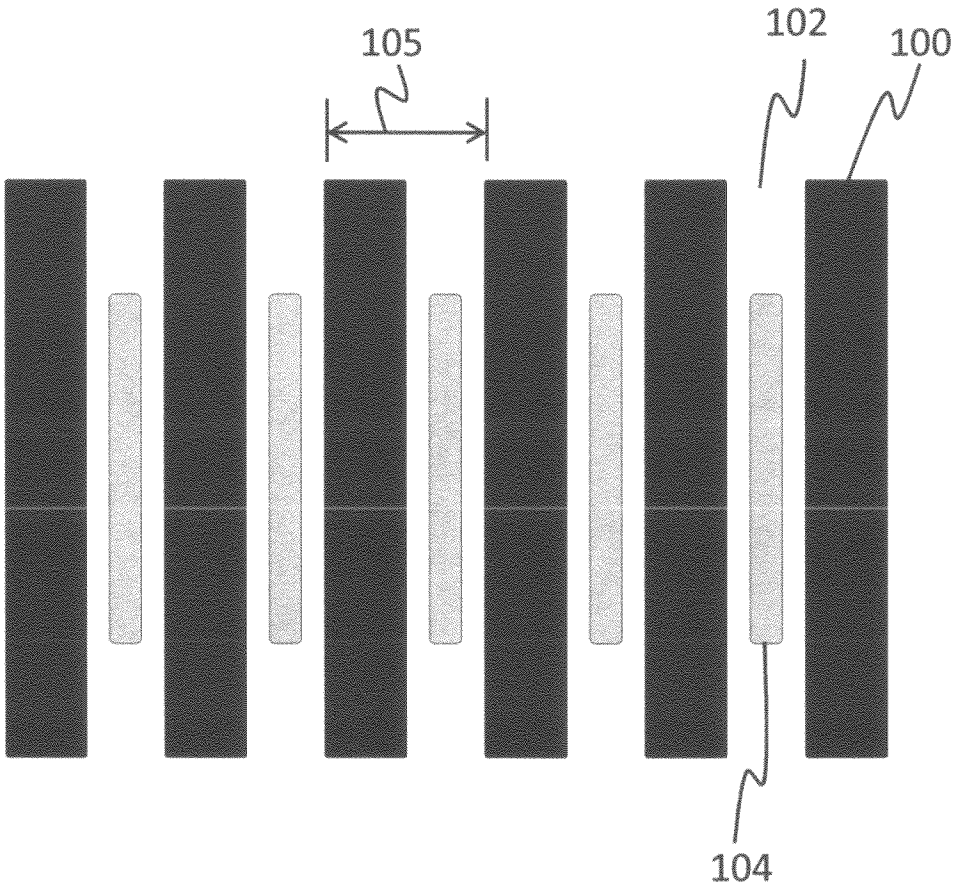
FIG. 5 is a representation of a portion of the print media including a spatially periodic printed pattern and induced print defects.

Referring to FIG. 5, although this printing system works well, certain print situations have been found to produce print defects, commonly referred to as print artifacts. When certain repeated patterns of spaced apart broad character strokes 100 are printed, diffuse regions of scattered ink spots 104 have been found in the spaces 102 between the character strokes. The presence of these undesirable ink spots 104 depends on the spatial period of the pattern of the character strokes and on the print speed; the print defect is more pronounced at high print speeds. Without wishing to be bound by the understanding of the physics involved, this form of print defect seems to be an outcome of a resonance excited by the spatially periodic application of drop forming waveforms, which are required to print the spatially periodic print pattern 105.

Figure 6:
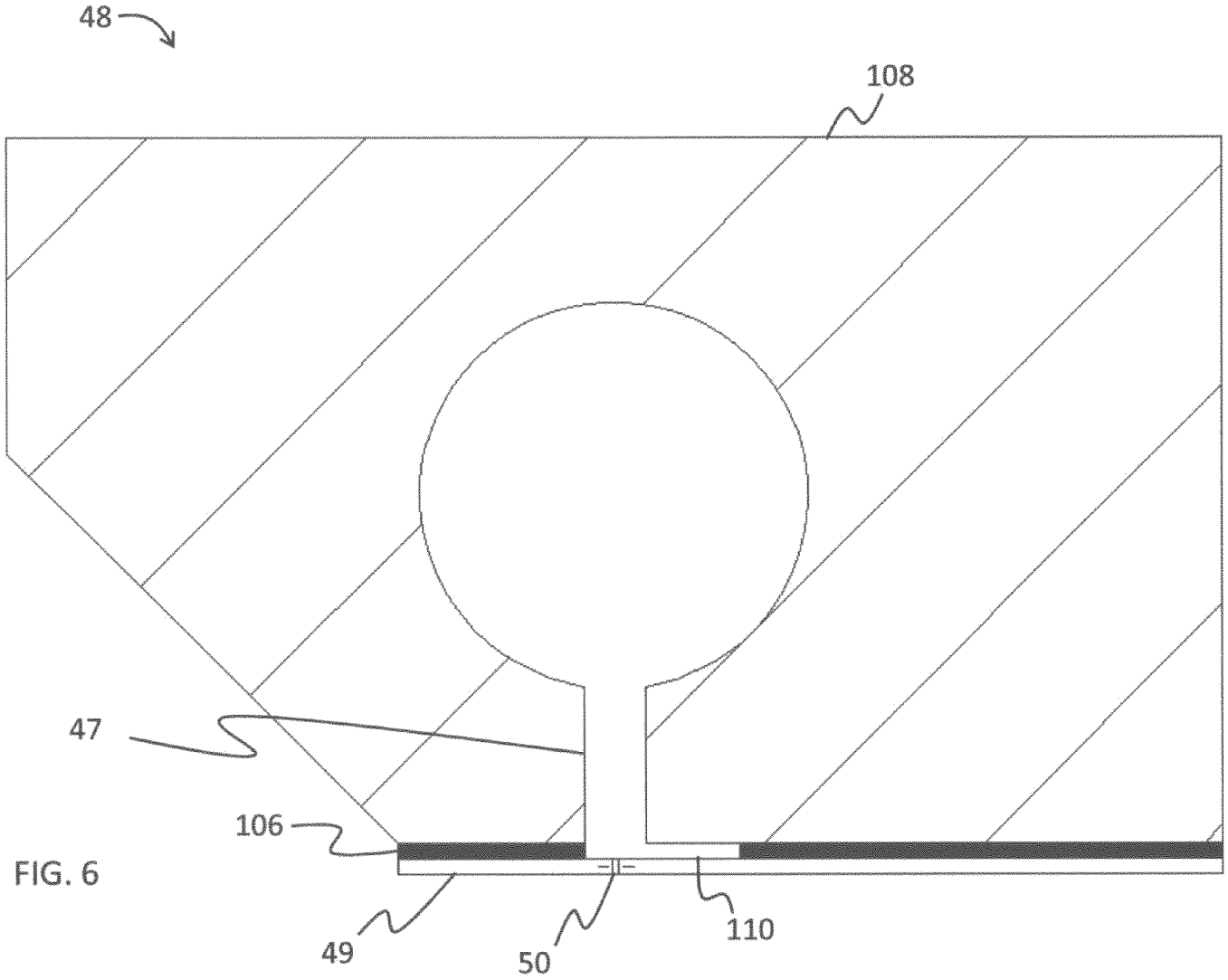
FIG. 6 is a schematic side cross sectional view of an example embodiment of a jetting module made in accordance with the present invention.
Figure 7:
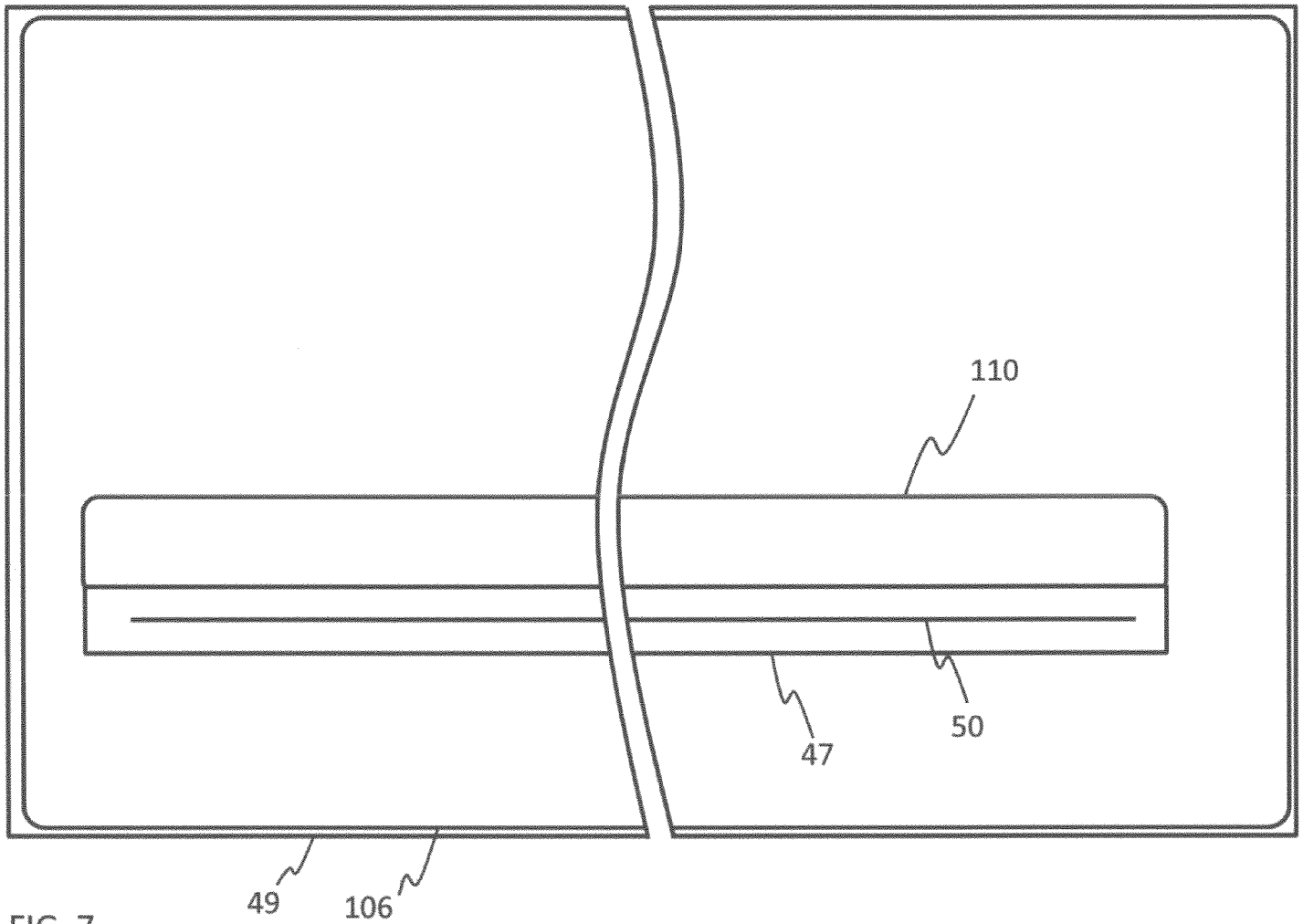
FIG. 7 is a schematic plan cross sectional view of the example embodiment of FIG. 6 of a jetting module made in accordance with the present invention.

Referring to FIG. 6, it has been found that this print defect can be suppressed by the presence of a cavity 110 located between the nozzle plate 49 and the manifold body 108. The cavity 110 is formed at the adhesive 106 bond line between the nozzle plate 49 and the jetting module body 108, adjacent to the ink channel 47 so that the cavity 110 is fluidically coupled to the liquid channel 47. As shown in FIG. 7, the cavity 110 extends along the ink channel substantially the length of the ink channel 47, so that the cavity 110 can be considered fluidically common to a plurality of nozzles 50 rather than being associated with only a single nozzle.

Figure 8:
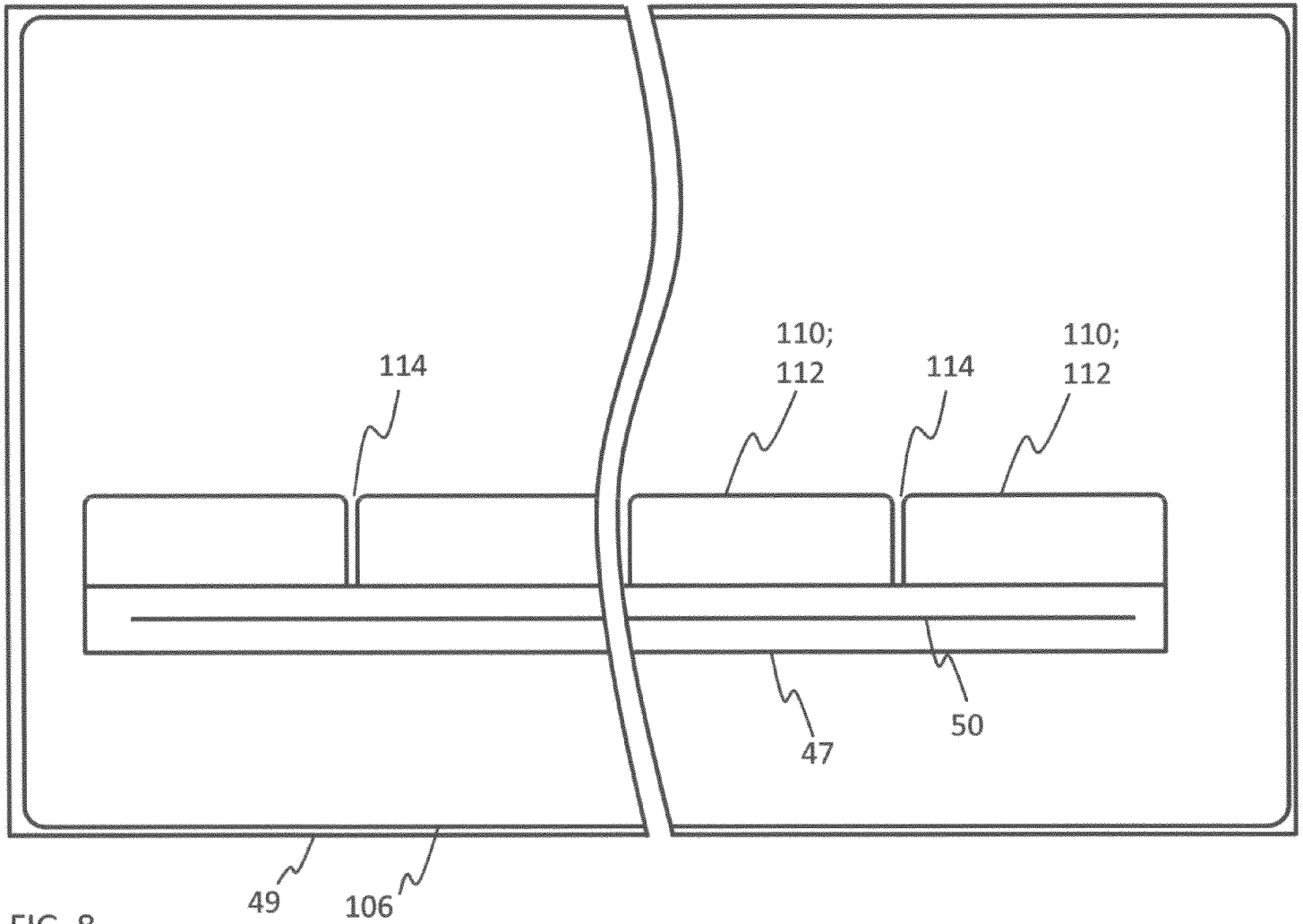
FIG. 8 is a schematic plan cross sectional view of another example embodiment of a jetting module made in accordance with the present invention.

Referring to FIG. 8, another embodiment is shown in which the cavity 110 has been separated into more than one segment 112 by the presence of one or more support ribs 114. The segments 112 of the cavity 110 each extend along a portion of the ink channel 47 and are fluidically common to a plurality of nozzles 50 rather than being associated with only a single nozzle. The ribs 114 can be formed of the adhesive material or of rib structures formed in the manifold body 106 or the orifice plate 49.

Figure 9:
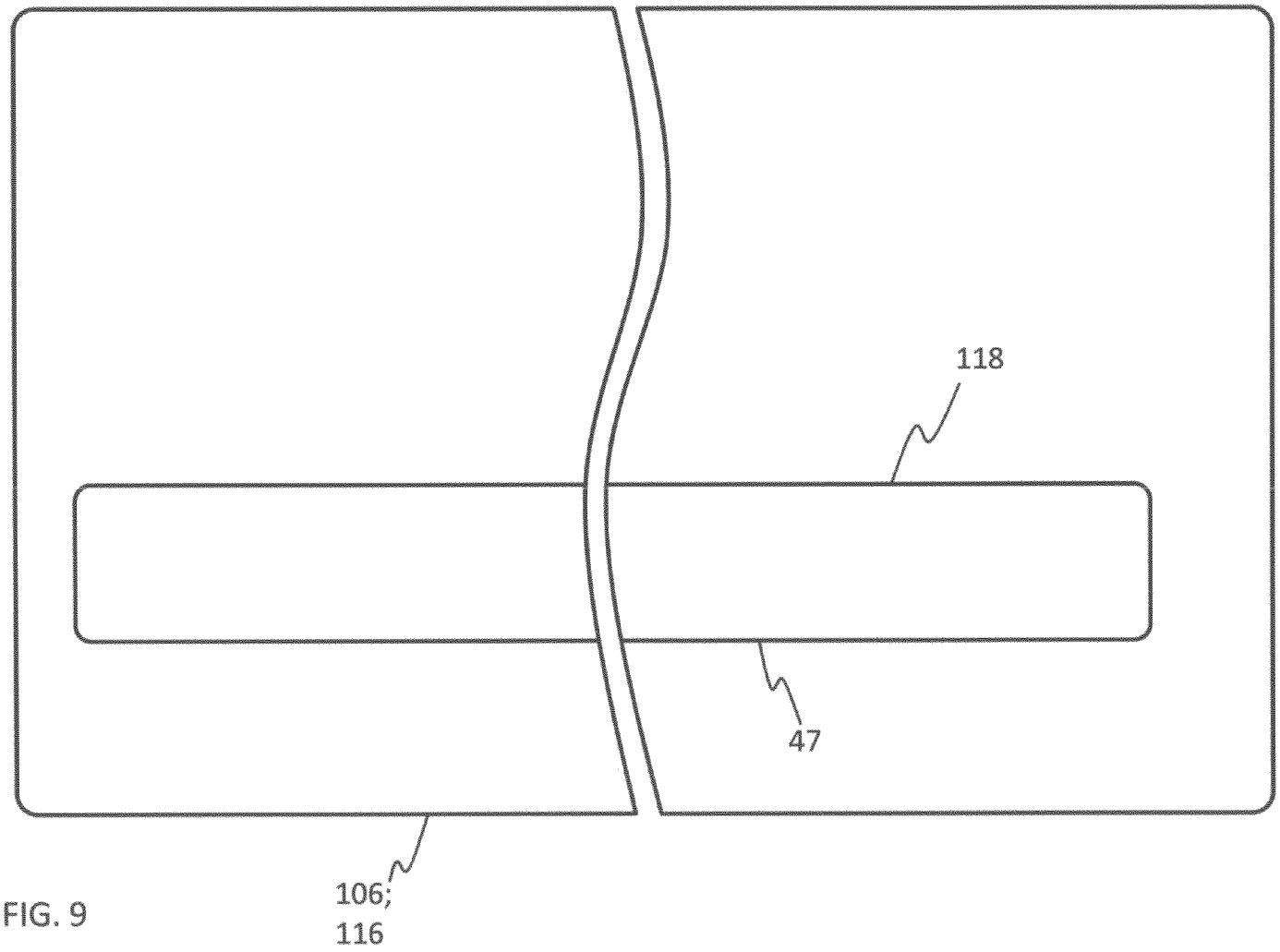
FIG. 9 is a plan view of an adhesive pre-form for use in an embodiment of the present invention.

The cavity 110 can be formed at the adhesive 106 bond line between the manifold body 108 and nozzle plate 49 in several ways. In one example embodiment, the adhesive 106 used is an adhesive having a viscosity sufficiently high such that the adhesive does not flow into and fill the cavity during its application. One example of such a high viscosity adhesive includes a B-staged epoxy adhesive film. As shown in FIG. 9, epoxy adhesive 106 films can be supplied as an adhesive preform 116 having a shape selected to provide the desired bond shape. The adhesive preform 116 can include a cutout 118 having a shaped selected to form the cavity 110 at the bond line between the nozzle plate 49 and the manifold body 108 adjacent to the ink channel 47. Depending on the B-staged epoxy film used, the desired geometry of the adhesive preform 116 can be produced by a screen printing, die cutting, or laser cutting. During the high temperature curing process, the B-staged epoxy adhesive film retains sufficient viscosity to prevent the adhesive 106 from flowing into the cavity 110.

Figure 10:
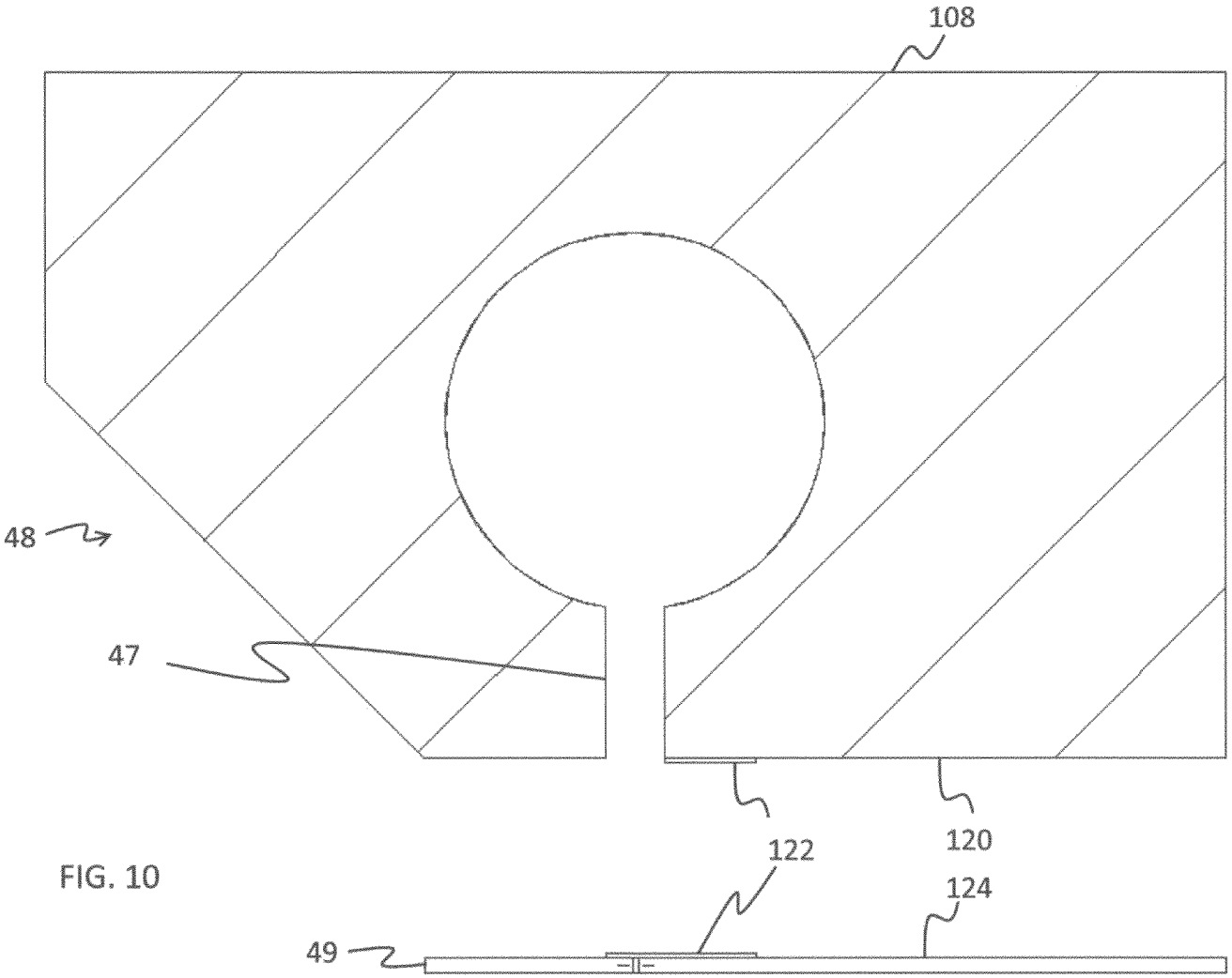
FIG. 10 is an exploded side cross sectional view of an example embodiment of a jetting module made in accordance with the present invention.

In another embodiment, shown in FIG. 10, a mask 122 can be applied to portions of one or both of the bonding surface 120 of the manifold body 48 or the bonding surface 124 of the nozzle plate 49 to prevent adhesive 106 from flowing into the cavity 110 region during the bonding process. The mask 122 can include an anti-wetting coating applied to the desired regions of the nozzle plate 49 or the manifold body 108 to prevent the flow of adhesive into the cavity region. Alternatively, the mask 122 can include a sacrificial material that spans the thickness of the adhesive 106 to fill the region desired for the cavity 110. Once the adhesive 106, applied to the non-masked regions to bond the nozzle plate 49 to the manifold body 108, is cured, the sacrificial mask 122 material can be removed through the ink channel 47.

Figure 11:
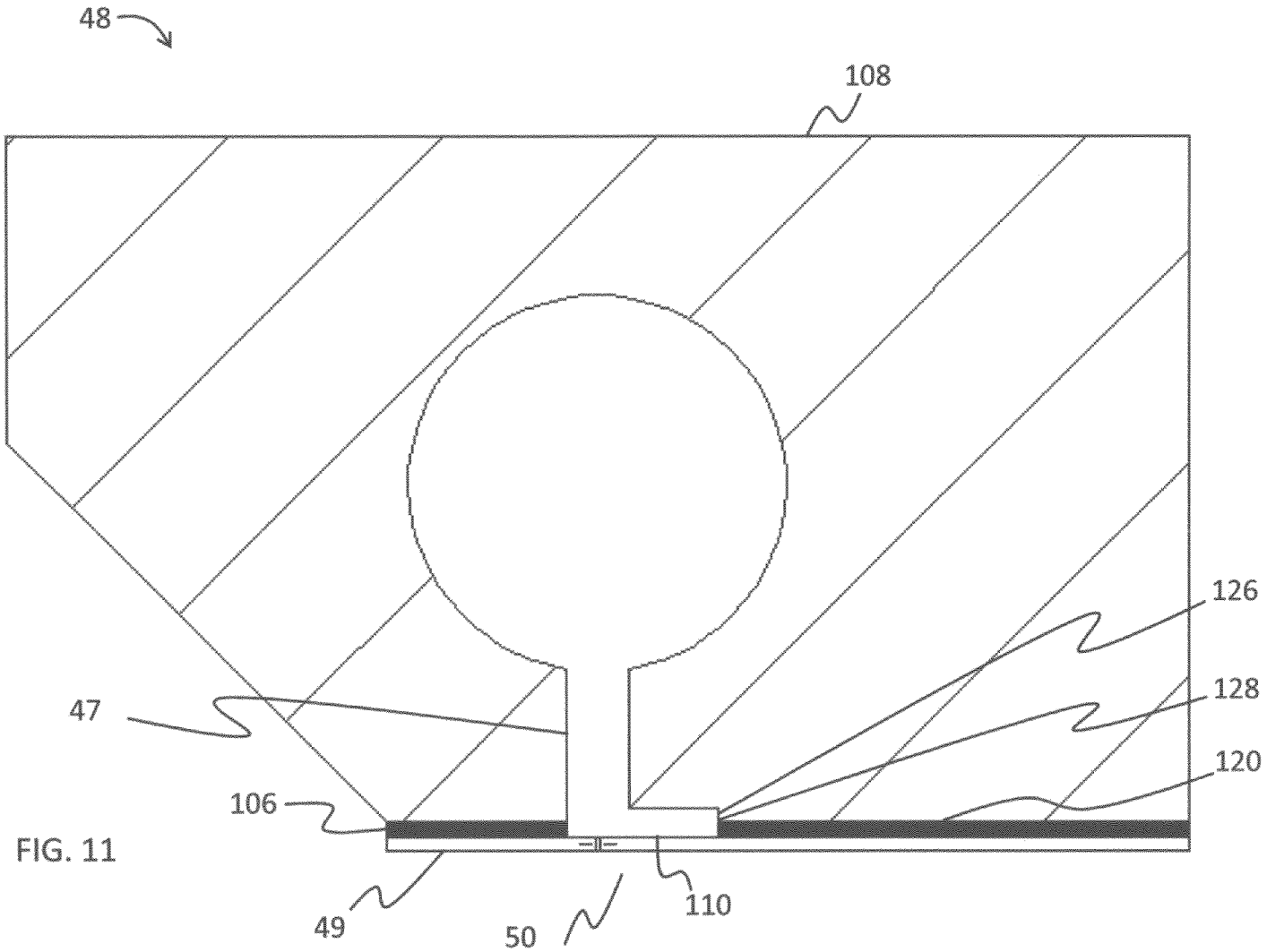
FIG. 11 is a schematic side cross sectional view of another example embodiment of a jetting module made in accordance with the present invention.

In another embodiment, shown in FIG. 11, the bonding surface 120 of the manifold body 48 includes a step 126 away from the nozzle plate 49. The step 126 creates an outside corner 128 that the adhesive 106 must flow around for the adhesive 106 to fill in the cavity 110. As the surface tension of adhesive 106 will naturally resist such a flow around an outside corner 128, step 126 serves as a barrier to prevent the flow of adhesive 106 into the cavity 110 region.

Figure 12A:
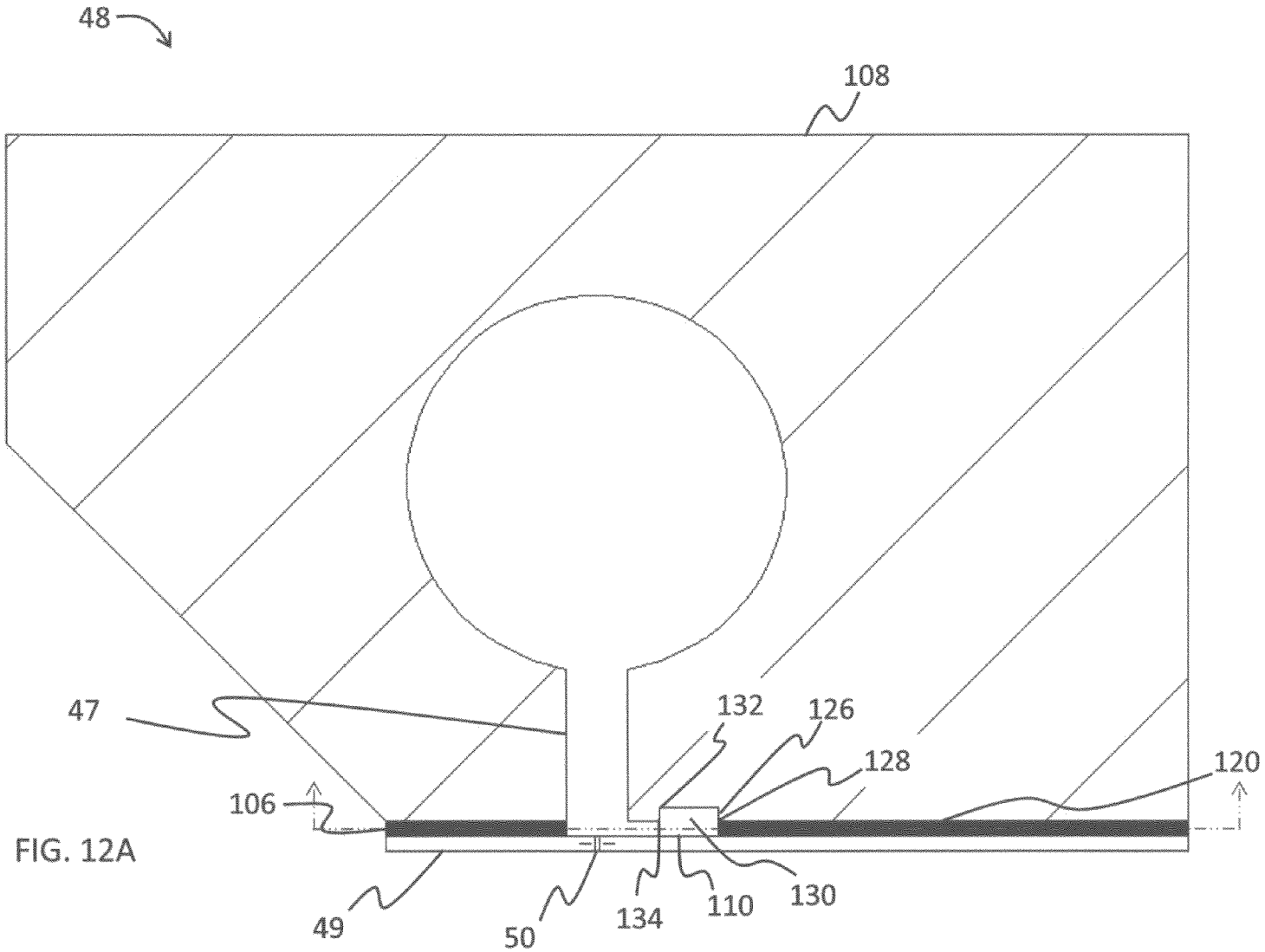
FIG. 12A is a schematic side cross sectional view of another example embodiment of a jetting module made in accordance with the present invention.

In another embodiment shown in FIGS. 12A and 128, the bonding surface 120 of the manifold body 48, like the embodiment of FIG. 11, includes a step 126 away from the nozzle plate 49. In this embodiment, the step 126 includes a recess 130 in the manifold body 108. The recess 130 provides additional volume to hold any adhesive that might have flowed around the outside corner 128. The recess 130 also creates an additional inside corner 132 to help retain any adhesive that flowed into the recess, and an addition outside corner 134 to resist the flow of adhesive past the recess 130. Additionally, as pressure fluctuations induce fluid flow into and out of the recess 130, the fluid must flow around the outside corner 134 producing viscous energy losses to enhance the damping of pressure fluctuations in the liquid channel 47.

Figure 12B:
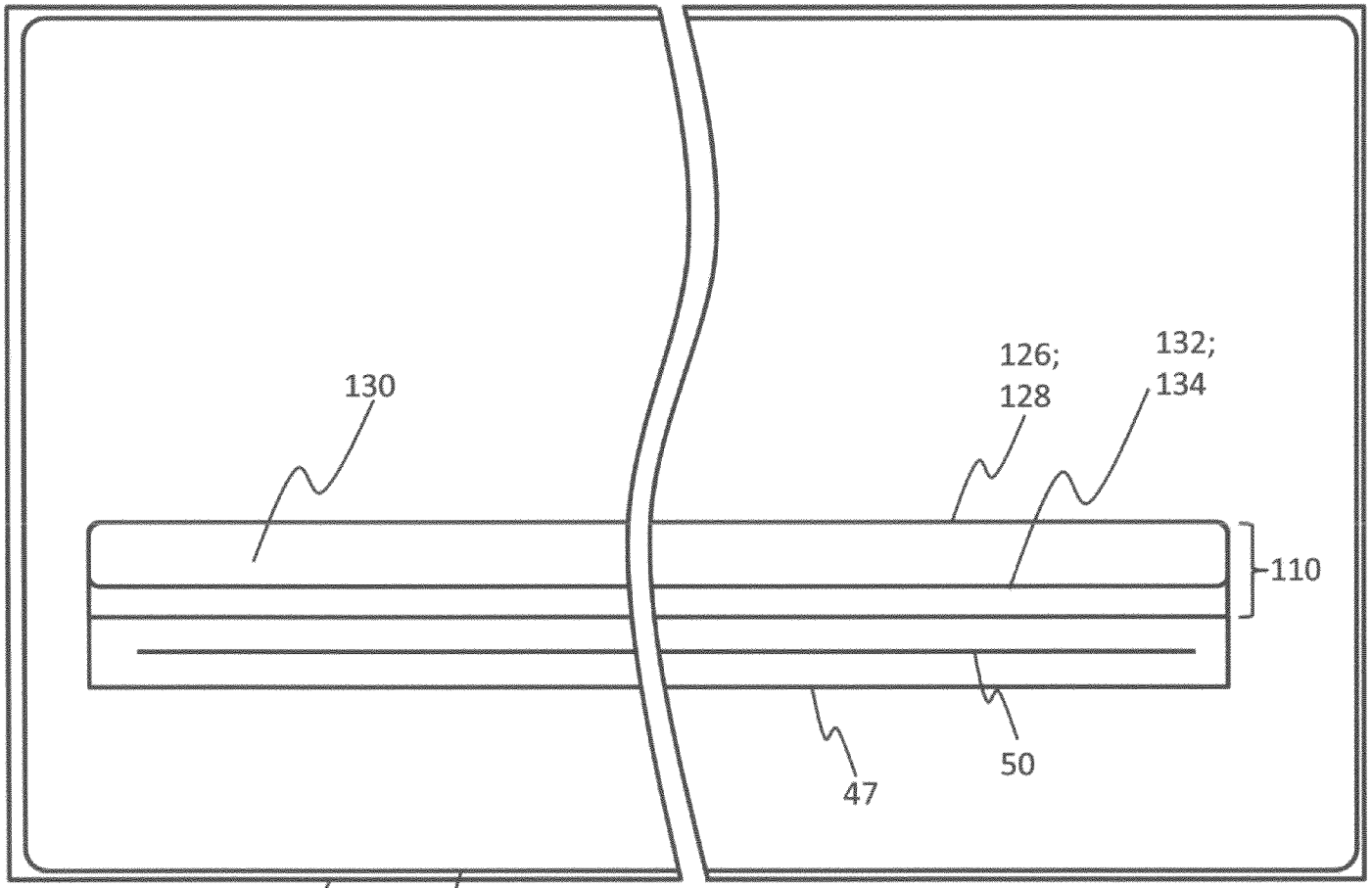
FIG. 12B is a schematic plan cross sectional view of the example embodiment of FIG. 12A of a jetting module made in accordance with the present invention.
Figure 13A:
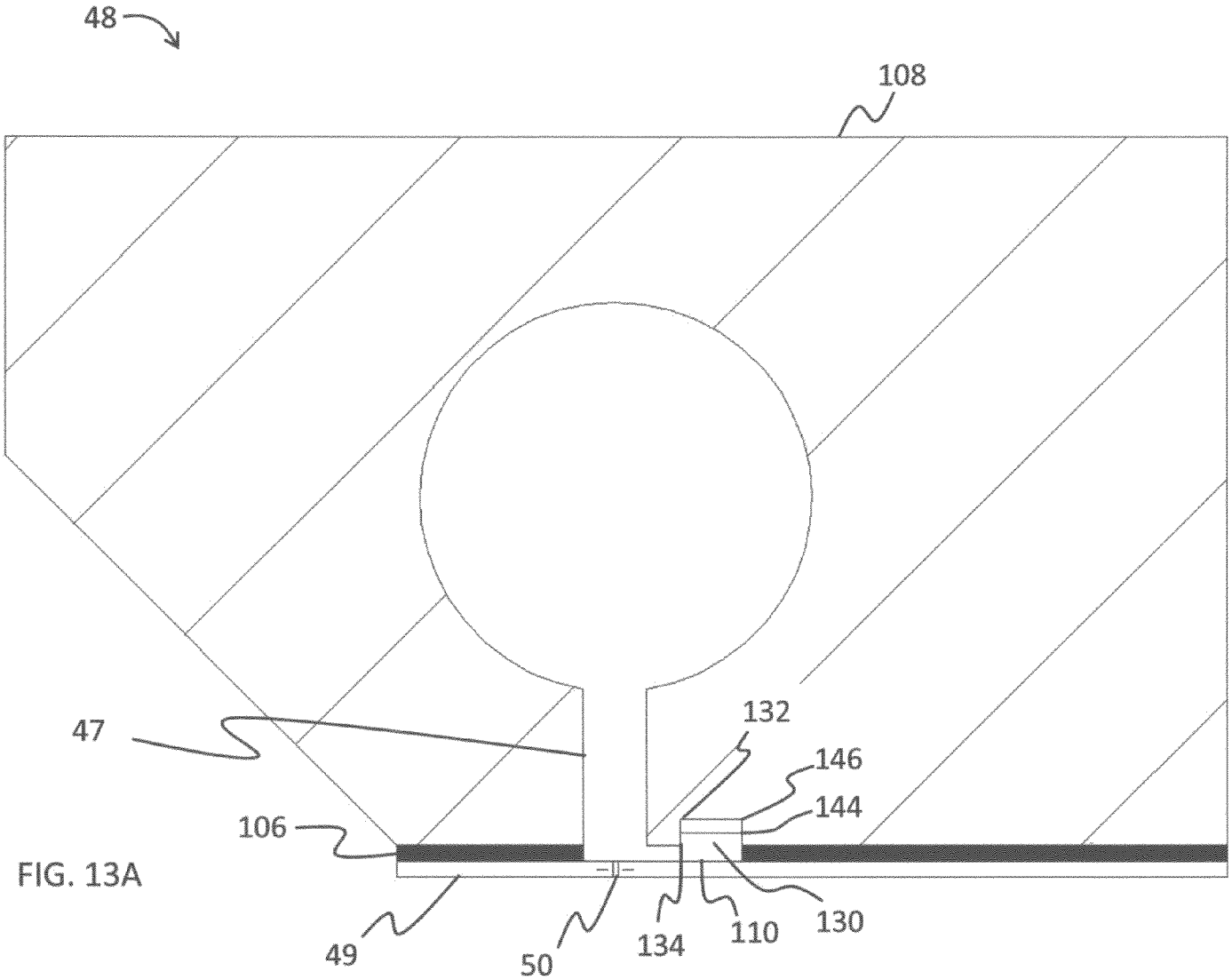
FIG. 13A is a schematic side cross sectional view of another example embodiment of a jetting module made in accordance with the present invention.
Figure 13B:
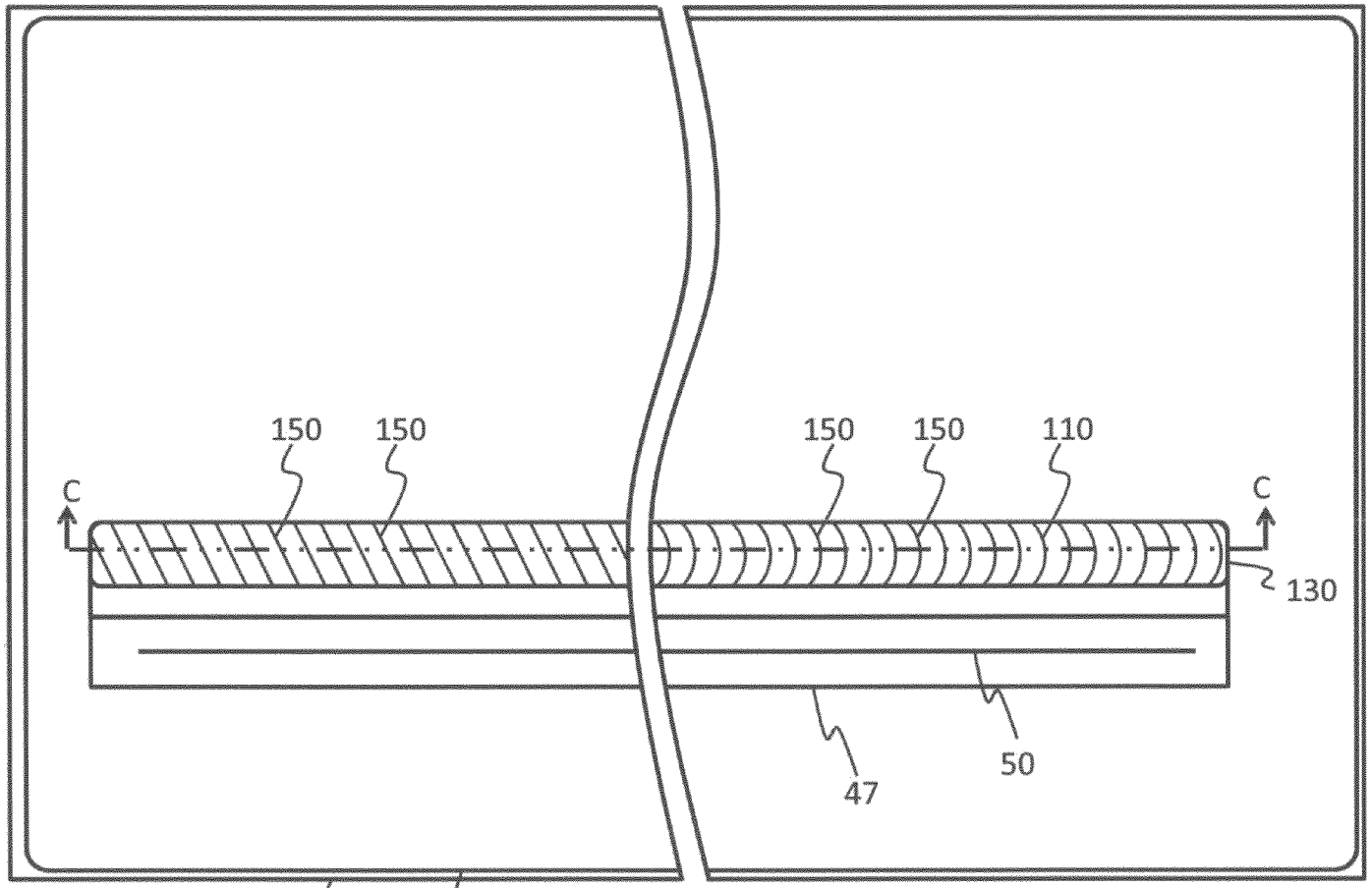
FIG. 13B is a schematic plan cross sectional view of the example embodiment of FIG. 13A of a jetting module made in accordance with the present invention.
Figure 13C:
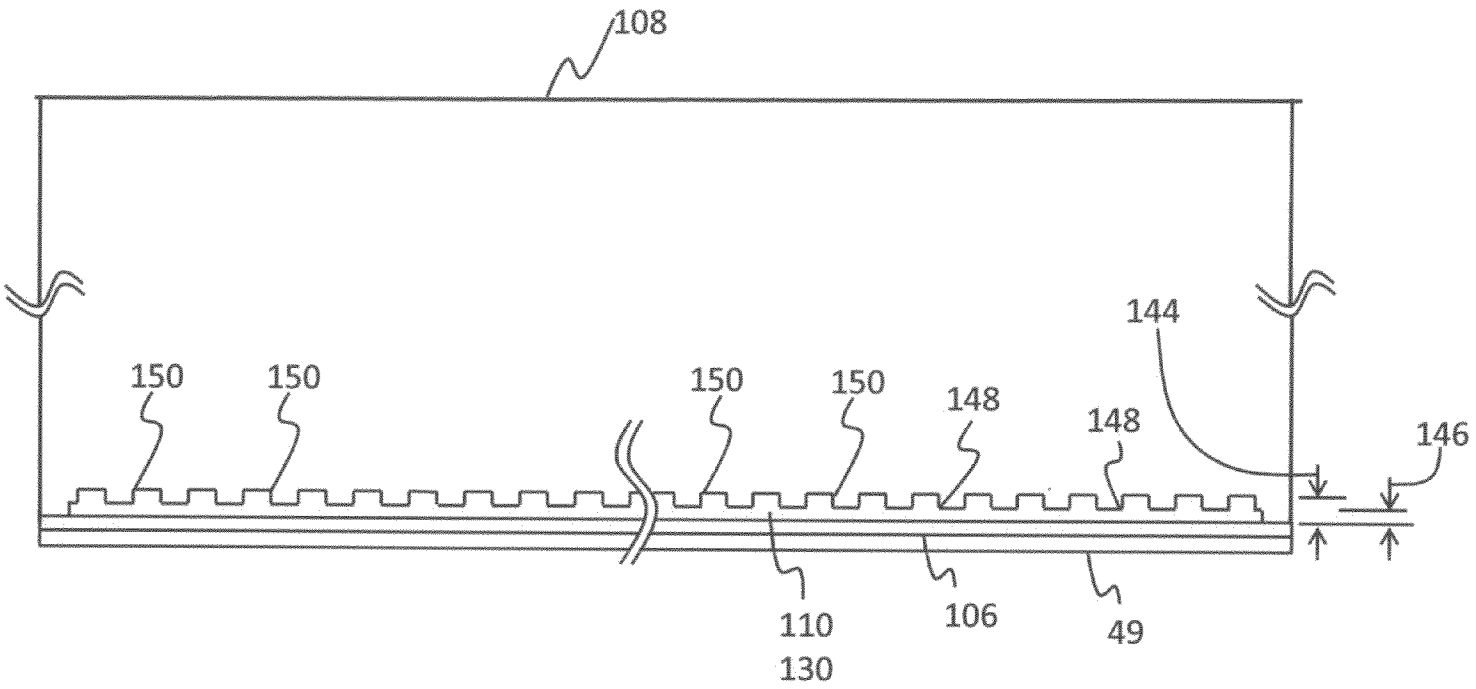
FIG. 13C is a schematic front cross sectional view of the example embodiment of FIG. 13A, taken along line C-C FIG. 13B, of a jetting module made in accordance with the present invention.

The embodiment shown in FIGS. 13A-13C, like that of FIG. 12 includes a recess 130. The depth of recess 130, however, is not uniform down the length of the recess 130. As shown in FIG. 13C, the recess depth is stepped between a first depth 144 and a second depth 146. Pressure fluctuations that would induce a fluid flow in the recess 130 parallel to the length direction of the recess 130 cause the fluid to flow around the plurality of outside corners 148 producing viscous energy losses to enhance the damping of pressure fluctuations in the liquid channel 47. The plurality of steps 150 between the first and the second depths 144, 146 that produce the plurality of outside corners 148 can include various shapes. For example, as shown in FIG. 13B, the steps 150 on the left portion of the recess 130 of the figure include diagonally oriented straight steps 150. The steps 150 on the right portion of the recess 130 of the figure include an arc shape. It is anticipated that other step shapes can be effectively used. For example, as shown in FIG. 13C, the steps 150 are orthogonal to the cavity 110. In the example embodiment shown in FIGS. 13A-13C, the steps 150 are uniformly spaced along the length of the recess. It is anticipated that non-uniform step spacings can also be used.

Figure 14:
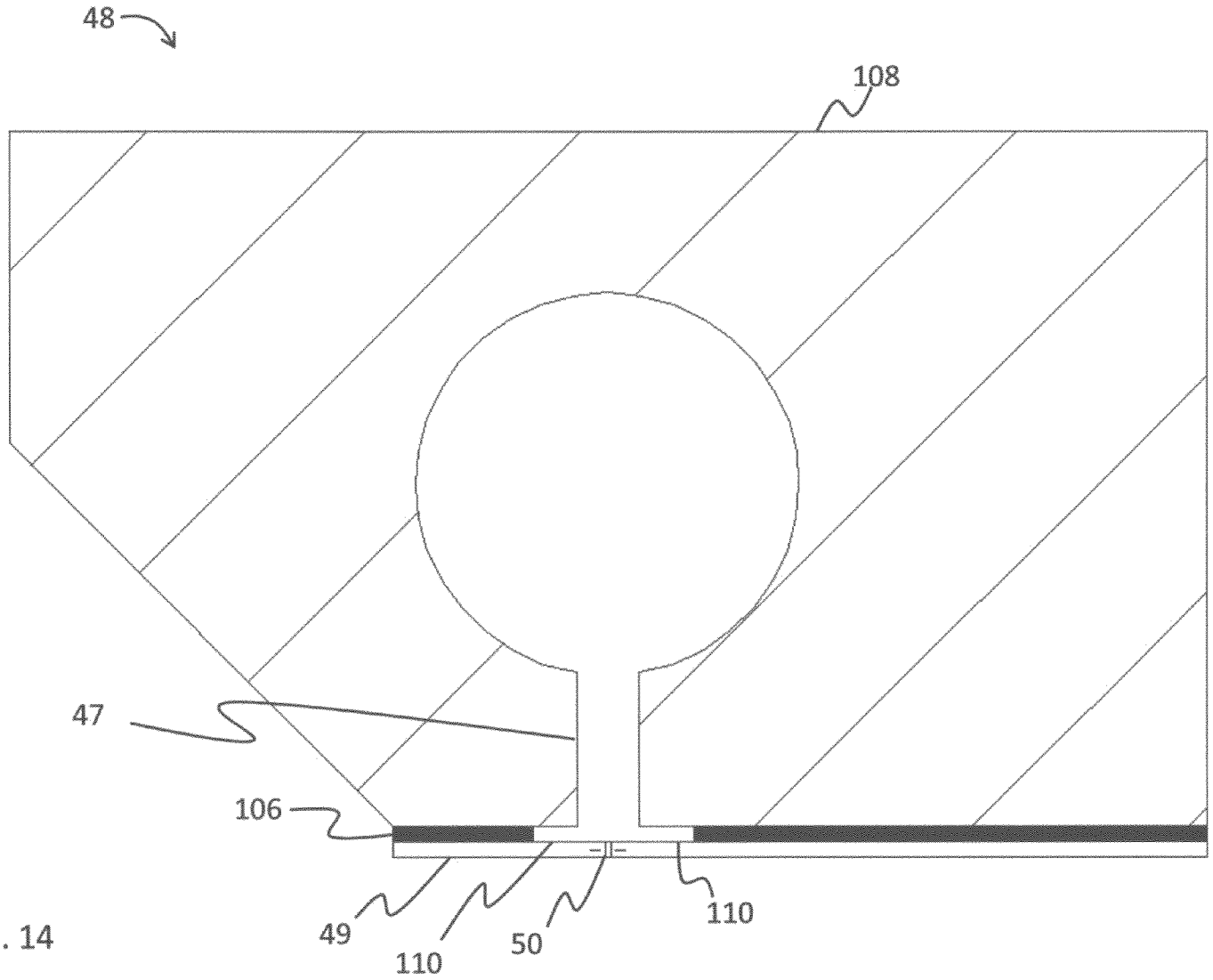
FIG. 14 is a schematic side cross sectional view of another example embodiment of a jetting module made in accordance with the present invention.

In another embodiment, the cavity 110 can be formed by a combination of a step 150, with or without the recess 130, and a masking of the cavity 110 region as described earlier with reference to FIG. 10. As shown in FIGS. 6-13, cavity 110 is positioned on only one side of the nozzle array 50; cavity 110 can also be placed on both sides of the nozzle array 50 as shown in FIG. 14.

Figure 15:
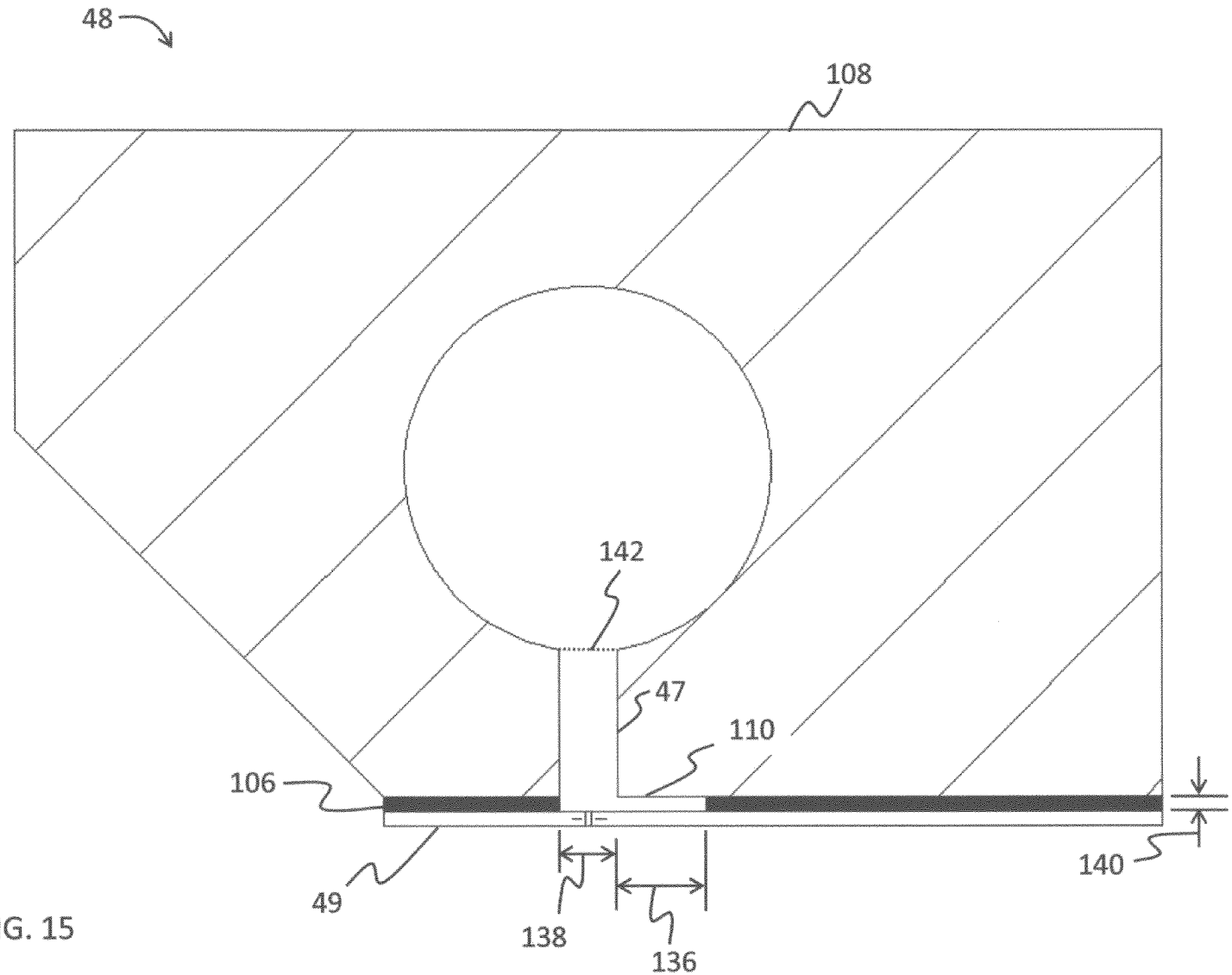
FIG. 15 is a schematic side cross sectional view of another example embodiment of a jetting module made in accordance with the present invention.

Referring to FIG. 15, cavity 110 for suppression of print pattern dependent artifacts can be employed in jetting modules that include an internal filter 142. Filter 142 serves to protect the nozzles 50 from particles that might affect the directionality of liquid filaments that flow from the nozzles. It has been found for a jetting module 48 having a fluid channel 47 width 138 of 1.5 mm that the suppression of the print pattern dependent print defects is most significant when the depth 136 of the cavity 110 is in the range of 0.5 to 1.0 mm. More generally, the depth 136 of the cavity 110 divided by the width 138 of the fluid channel 47 is in the range of 0.33-0.66. The height of cavity 110 is preferably within the range of 12 to 76 mm to significantly affect print pattern dependent print defects or artifacts. As the preferred depth of the cavity 110 is approximately equal to ¼ of a wavelength of a sound wave in the liquid at the drop creation frequency, it is thought that the cavity 110 serves as a quarter wave damper to suppress the pattern dependent print defect in at least some embodiments. It is also thought that viscous losses of the oscillating flow of fluid into and out of the thin cavity 110 contributes to the damping that suppresses the pattern dependent print defect in at least some embodiments. The various embodiments of the cavity 110 for the suppression of the print pattern dependent print defects described above are effective without the need for pressure damping materials in the ink channel 47 of the jetting module 48 or pressure damping air pockets within or coupled to the ink channel 47 of the jetting module 48.

The invention has been described in detail with particular reference to certain preferred embodiments thereof, but it will be understood that variations and modifications can be effected within the scope of the invention.

PARTS LIST

20 Continuous printing system
22 Image source
24 Image processing unit
26 Control circuit
28 Drop forming mechanism
30 Printhead
32 Recording medium
34 Transport system
36 Transport control system
38 Micro-controller
40 Ink Reservoir
42 Ink catcher
44 Ink recycling unit
46 pressure regulator
47 Ink channel
48 Jetting module, manifold
49 Nozzle plate
50 Nozzle
51 Heater
52 Filaments of liquid
54 Drop
56 Drop
57 Trajectory
58 Drop stream
60 Gas flow deflection mechanism
61 Positive pressure gas flow structure
62 Gas flow
63 Negative pressure gas flow structure
64 Deflection zone
66 Small drop trajectory
68 Large drop trajectory
72 First gas flow duct
74 Lower wall
76 Upper wall
78 Second duct
82 Upper wall
84 Seal
86 Return duct
88 Plate
90 Front face
92 Positive pressure source
94 Negative pressure source
96 Wall
100 Stroke
102 Space

104 Diffuse region
105 Spatial period
106 Adhesive
108 Jetting module body, manifold body
110 Cavity
112 Segment
114 Support rib
116 Preform
118 Cutout
120 Mask
122 Bonding surface
124 Bonding surface
126 Step
128 Outside Corner
130 Recess
132 Inside corner
134 Outside corner
136 Depth
138 Width
140 Height
142 Filter
144 First depth
146 Second depth
148 Outside corner
150 Step

The invention claimed is:

1. A printhead comprising:

a nozzle plate including a plurality of nozzles;

a manifold body bonded to the nozzle plate, the manifold body including a liquid channel in fluid communication with the plurality of nozzles, the liquid channel having a length; and a cavity located between the nozzle plate and the manifold body that dampens pressure modulation in liquid channel of the manifold body, the cavity extending along the ink channel, substantially along the length of the ink channel such that the cavity is fluidically common to the plurality of nozzles.

2. The printhead of claim 1, the manifold body being bonded to the nozzle plate with an epoxy, wherein the cavity is located adjacent to the liquid channel in an area where there is no epoxy present.

3. The printhead of claim 2, wherein at least one of the manifold body and the nozzle plate include an anti-wetting coating that controls an ending location of the epoxy in the area of the cavity.

4. The printhead of claim 2, wherein the manifold body includes an internal step that controls an ending location of the epoxy.

5. The printhead of claim 1, wherein the cavity includes an internal step in the manifold body.

6. The printhead of claim 1, wherein the cavity is positioned only on one side of the plurality of nozzles.

7. The printhead of claim 1, wherein at least one of the manifold body and the nozzle plate include an anti-wetting coating in the area of the cavity.

8. The printhead of claim 1, wherein the cavity includes a support rib located between the nozzle plate and the manifold body.

9. The printhead of claim 8, the manifold body being bonded to the nozzle plate with an epoxy, wherein the cavity is located adjacent to the liquid channel in an area where there is no epoxy present, and wherein the support rib includes epoxy that extends toward the liquid channel.

10. A method of ejecting liquid drops through a printhead comprising:

providing a printhead including:

a nozzle plate including a plurality of nozzles;

a manifold body bonded to the nozzle plate, the manifold body including a liquid channel in fluid communication with the plurality of nozzles, the liquid channel having a length; and a cavity located between the nozzle plate and the manifold body that dampens pressure modulation in liquid channel of the manifold body, the cavity extending along the ink channel, substantially along the length of the ink channel such that the cavity is fluidically common to the plurality of nozzles;

providing liquid to the printhead under pressure sufficient to emit a filament of liquid through the plurality of nozzles of the printhead; and selectively actuating a drop forming device associated with one of the plurality of nozzles of the printhead to form liquid drops from the filament of liquid emitted through the associated nozzle of the plurality of nozzles.

* * * * *